United States Patent [19]

Bauer

[11] 4,107,873

[45] Aug. 22, 1978

[54] STUFFED REVERSIBLE DOLL

[76] Inventor: Adeline L. Bauer, Rte. 1, Trempealeau, Wis. 54661

[21] Appl. No.: 747,062

[22] Filed: Dec. 3, 1976

[51] Int. Cl.[2] ..... A63H 3/12

[52] U.S. Cl. ..... 46/153

[58] Field of Search ..... 46/153, 151, 158, 159, 46/160

[56] References Cited

U.S. PATENT DOCUMENTS

| | | | |
|---|---|---|---|
| 1,396,766 | 11/1921 | McClelland | 46/153 |
| 1,600,359 | 9/1926 | Putman | 46/158 |
| 1,966,986 | 7/1934 | Martin | 46/153 |

FOREIGN PATENT DOCUMENTS

| | | | |
|---|---|---|---|
| 940,704 | 6/1948 | France | 46/153 |
| 271,397 | 10/1950 | Switzerland | 46/158 |

*Primary Examiner*—F. Barry Shay
*Attorney, Agent, or Firm*—D. Paul Weaver

[57] ABSTRACT

A reversible doll includes a fully stuffed elongated body, the opposite longitudinal half sections of which form waist connected individual doll figures. Fabric coverings for the chest and back areas and the arms of the two doll figures match the fabrics employed in a reversible skirt for the doll. The necessity for separately constructing dress tops on the two doll figures is avoided, resulting in increased economy of manufacturing. The attached arms of the doll figures are firm so that they will remain substantially fixed and lie across the front of each figure with hands meeting near the center and substantially at the waist. Many simplified and improved constructional features are included.

2 Claims, 25 Drawing Figures

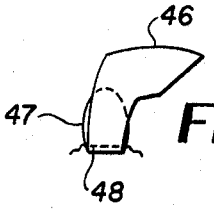
FIG. 22
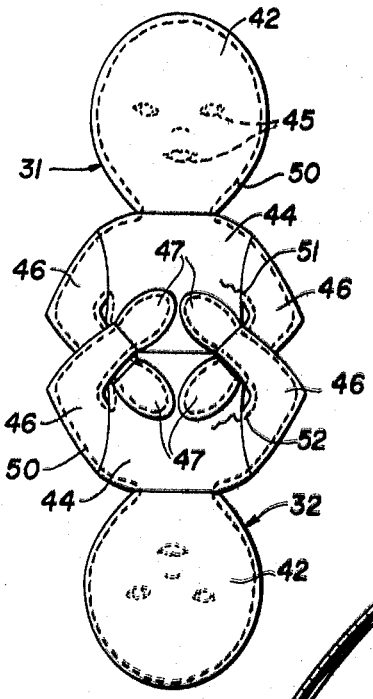
FIG. 24
FIG. 5
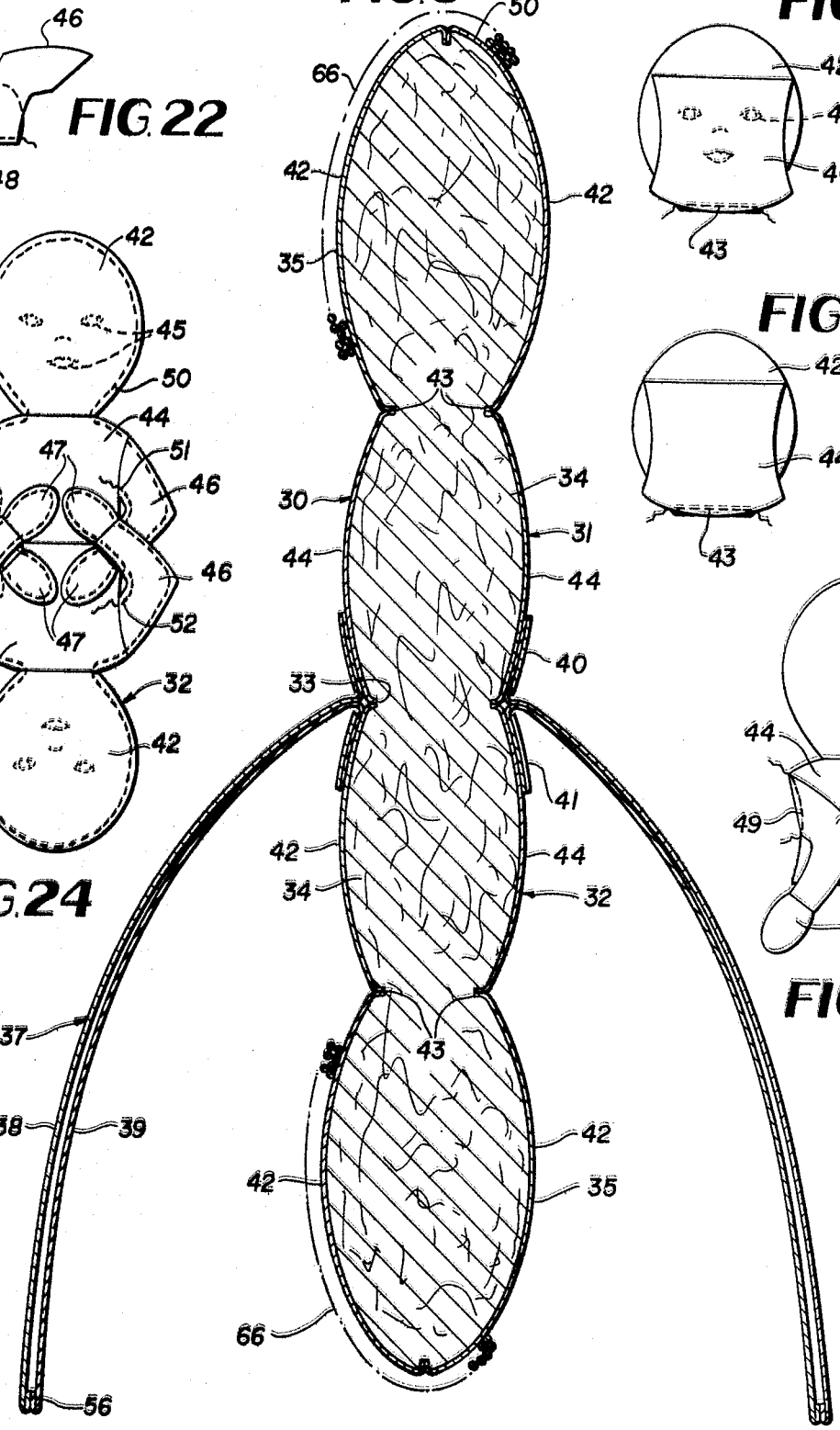
FIG. 20
FIG. 21
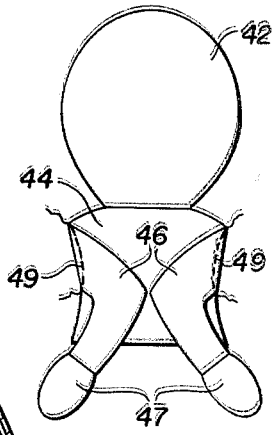
FIG. 23

FIG. 7
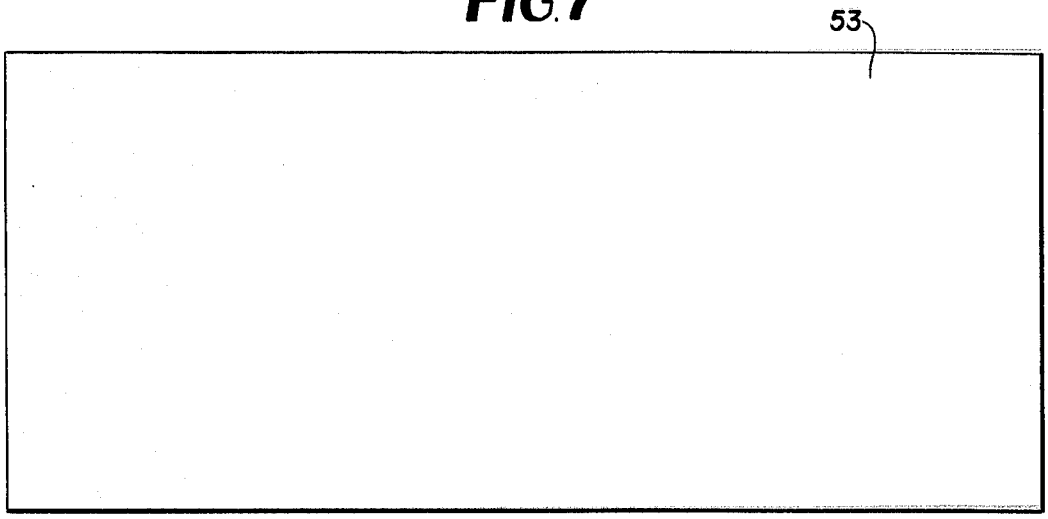
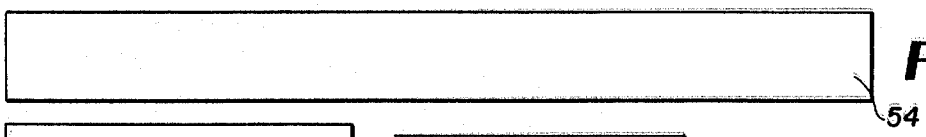
FIG. 12
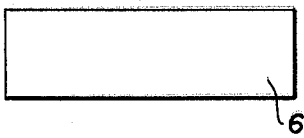
FIG. 11
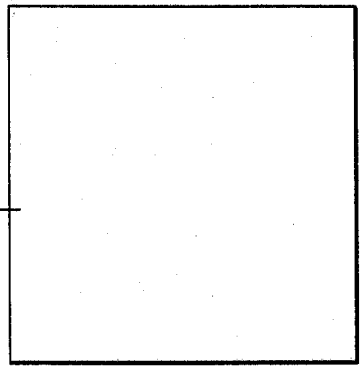
FIG. 9
FIG. 10
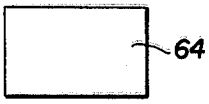
FIG. 8
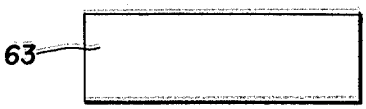
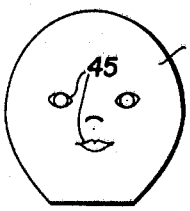
FIG. 13
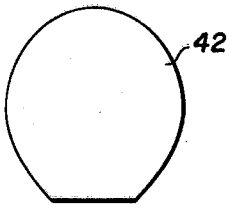
FIG. 14
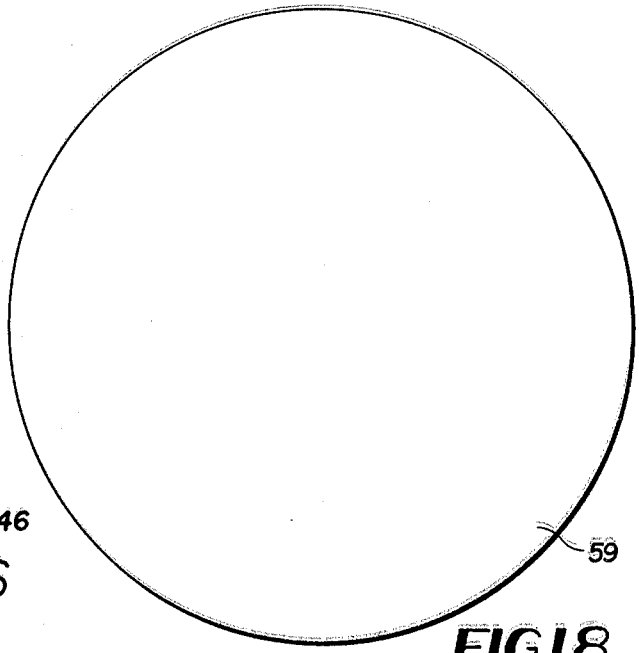
FIG. 18
FIG. 15
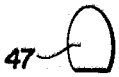
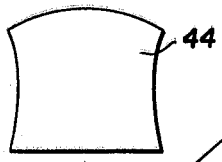
FIG. 17
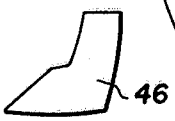
FIG. 16
FIG. 19
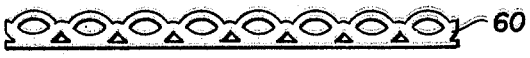

STUFFED REVERSIBLE DOLL

BACKGROUND OF THE INVENTION

Reversible double-ended dolls are known in the prior art, and two examples are disclosed in U.S. Pat. Nos. 1,396,776 and 1,966,986. The manufacturing of saleable dolls of this type tends to be tedious and costly and involves a great deal of hand work, tending to make it somewhat impractical from an economic standpoint to manufacture the dolls on a quantity basis.

In view of a recent increase in popularity of reversible dolls, it is the objective of this invention to significantly improve on the known prior art in terms of a reversible doll which is more attractive and more durable and which can be uniformly manufactured on a production basis with decreased labor and skill. The invention features a fully stuffed body, the opposite half sections of which form a pair of individual doll figures joined at a common waist. The body is comparatively rigid and therefore self-standing in contrast to the prior art where the body members tend to be flexible and unstable. In the invention, the stuffed arms of the two doll figures are shaped and secured in such a way that they tend to be stationary in crossing relationship at the front of each figure near the waist.

A major improvement feature in the invention comprises covering the chest, back and arm areas of each doll figure with decorative fabrics which exactly match the two fabrics of a reversible skirt attached to the unitary stuffed body at the common waist. Thus, two complete dresses for the doll figures are formed without the necessity for constructing upper dress portions separately and applying the same to the stuffed body and/or joining such upper dress portions to the fabricated skirt by separate operations. The resulting construction is much more practical and economical from a manufacturing standpoint and a better quality and more uniform quality product results. The amount of labor and the need for skill are also lessened in the invention.

The doll embodies a number of additional improvement features over the prior art which will be apparent during the course of the following detailed description.

BRIEF DESCRIPTION OF THE DRAWINGS

FIG. 5 is a longitudinal vertical section taken centrally through the reversible doll on line 5—5 of FIG. 1 and on an enlarged scale.

FIGS. 7 through 19 are plan views of fabric blanks employed in the formation of the reversible doll.

FIGS. 20 through 24 are illustrations of assembly steps involved in the construction of the stuffed double-ended body.

DETAILED DESCRIPTION

Figure 1:
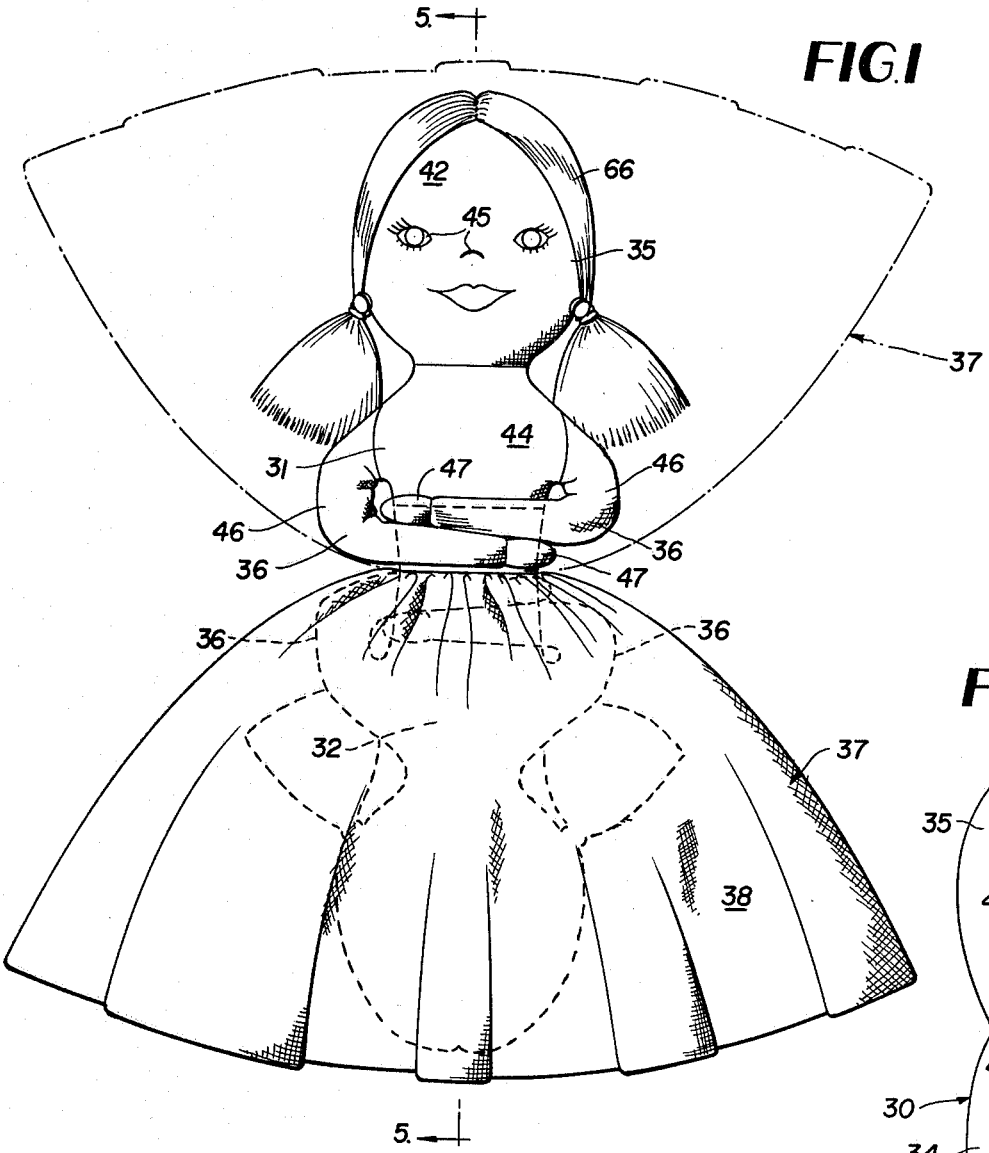
FIG. 1 is a front elevational view of a stuffed reversible doll embodying the invention with the reversible skirt shown in full lines in a position of use to expose one doll figure while concealing the other figure, the reversed position of the skirt being shown in phantom lines.
Figure 2:
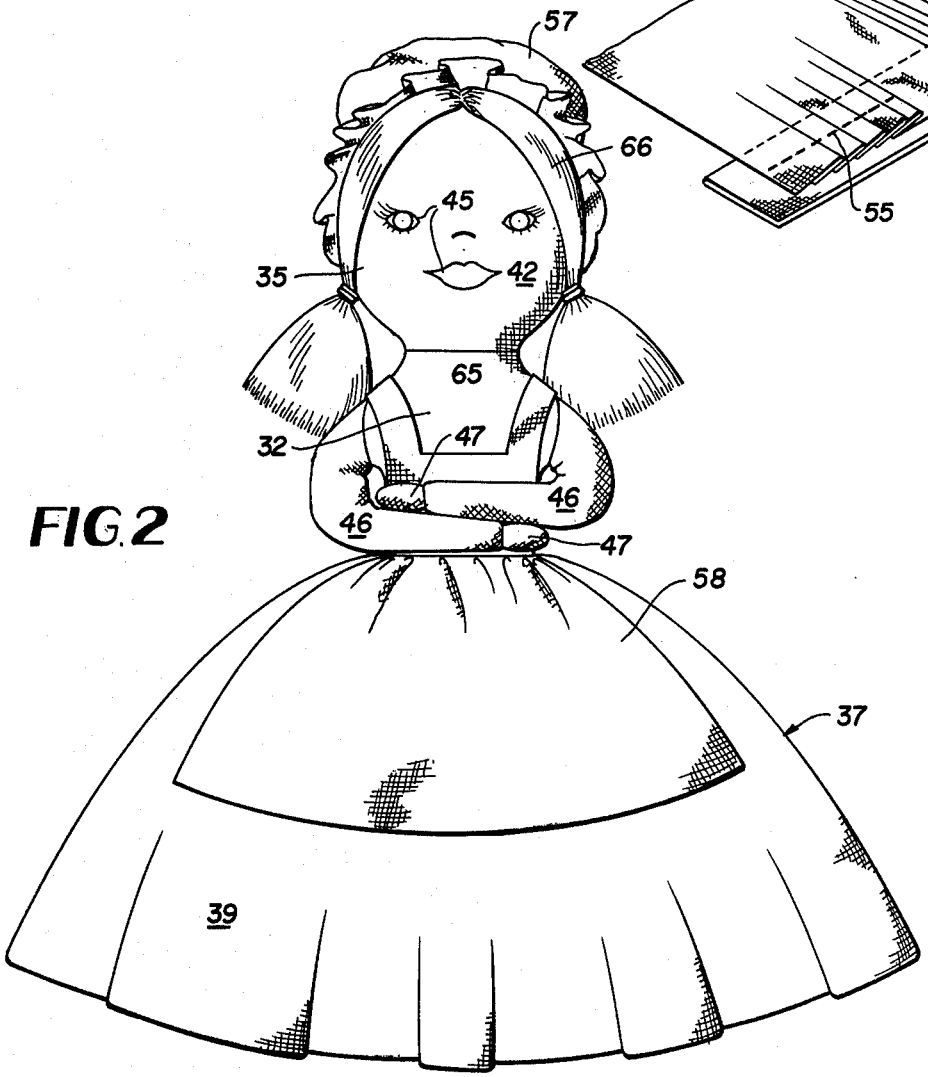
FIG. 2 is a front elevation of the doll with the skirt in the reversed position from that shown in FIG. 1.

Referring to the drawings in detail wherein like numerals designate like parts, a stuffed reversible doll embodying the invention comprises a unitary elongated fully stuffed body 30, the oppositely extending half sections 31 and 32 of which form integrally connected individual doll figures, such as those depicted in FIGS. 1 and 2. The two doll figures 31 and 32 are joined at a common waistline 33 at the longitudinal center of the unitary body 30. An important feature, differing from the prior art, is having the body 30 fully stuffed with polyester fiber or equivalent material to render the body comparatively stiff so that the doll can be self-standing and the sections of the body will not tend to flop about.

Each of the body half sections 31 and 32 includes a chest and back portion 34 and a head portion 35, the construction of which will be fully described. Stuffed arm and hand units 36 are carried by opposite sides of the chest and back portions 34 and the construction of the arm and hand units and their arrangement on the body 30 is another unique feature of the invention.

The stuffed reversible doll further comprises a reversible skirt 37 having two cloth plies 38 and 39 of differing and preferably non-similar coloring and design or decorative pattern. The decorative appearance of each skirt ply is usually contrasting so that two distinctively different doll figures are embodied in the reversible doll. The reversible skirt 37 is attached permanently to the waist portion of the body 30 with matching or compatible waistbands 40 and 41, as will be further described.

A major unique feature of the invention comprises covering the chest and back portions 34 and arm units 36 with cloth whose decorative patterns matches the cloth designs or patterns of the two skirt plies 38 and 39. That is, the cloth covering of one chest and back portion 34 and associated arms matches the skirt ply 38, and the cloth covering of the other chest and back portion 34 and associated arms matches the skirt ply 39. This unique arrangement avoids the necessity for separately fabricating upper dress sections for each doll figure 31 and 32 and applying such separate dress portions to the body 30 to form complete dresses with the reversible skirt. In the invention, the permanently attached cloth coverings provided on the chest and back portions 30 of the doll body and on the arms during fabricating of the body in effect become integral parts of two complete and distinctly different doll dresses in conjunction with the reversible skirt 37. The overall manufacturing process by this method is rendered simpler, less costly and results in the production of a better quality and more uniform product. The need for special skill is reduced.

The fabrication of the stuffed body 30 can be described briefly in connection with FIGS. 20 through 24. Referring to FIG. 20, a cloth head blank 42 is stitched at 43 to each cloth bodice 44, four of the blanks 42 and 44 having been precut and laid out as depicted in FIGS. 13, 14 and 17. On two of the head blanks 42, FIG. 13, facial features 45 are hand painted preferably before the fabrication or assembling of the doll body. In a large manufacturing operation, the facial features could be printed. The cloth head blanks 42 for the two doll figures 31 and 32 may be flesh-colored and may, if desired, be colored and painted to depict two different racial figures. FIG. 21, like FIG. 22, depicts the stitching together of a pair of head and bodice blanks 42 and 44 for the back of a doll figure and without facial painting on this particular blank 42, the elements in FIG. 20 being for the front of each figure 31 and 32.

FIG. 22 depicts the joining of two of eight arm and hand blanks 46 and 47 by stitching 48, such blanks being shown separately in FIGS. 15 and 16.

Following this, FIG. 23, a pair of arm sections composed of connected blanks 46 and 47 is stitched at 49 to opposite sides of each bodice blank 44 for the front and back of each figures 31 and 32 making up the composite stuffed body 30. In other words, the four arm and hand forming cloth units are stitched at 49 to the two bodices 44 for each figure 31 and 32, and at this point the right sides of the cloth are together or facing each other, with the wrong sides out.

The next step in the fabrication process is as follows. With the right sides of material together, the front bodice 44 of figure 31 is sewed to the back bodice 44 of figure 32 at the waist. Also, the back bodice of doll figure 31 is now sewed to the front bodice of doll figure 32 at the waist. The facial features 45 of the two doll figures are shown to be facing in the same direction in the finished product, although they can face in opposite directions, if desired. Following this, and with the right sides of the material still together, the front and back parts of the now joined blanks are conventionally pinned together temporarily at the heads, shoulders and arms and the two cloth layers or subassemblies are now ready for final attachment by stitching, as depicted in FIG. 24. The intermediate steps described immediately above are omitted in the drawings for simplicity. Referring to FIG. 24, the two superposed cloth subassemblies are now stitched around their margins with a proper seam allowance outwardly of the stitching, as shown. The marginal stitching 50 begins at the underarm for doll figure 31, at point 51, and ends at the same side underarm, point 52, for doll figure 32. One side of the attached cloth subassemblies between the two points 51 and 52 are left open for stuffing but the remainder of the entire margins of the two cloth layers are now joined by the continuous stitching 50.

Figure 4:
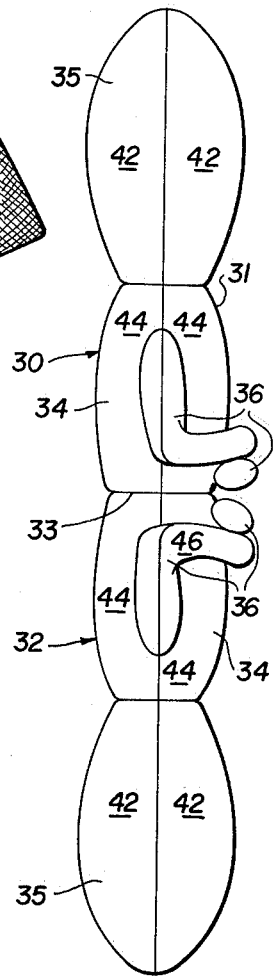
FIG. 4 is a side elevation of a stuffed body employed in the reversible doll.
Figure 3:
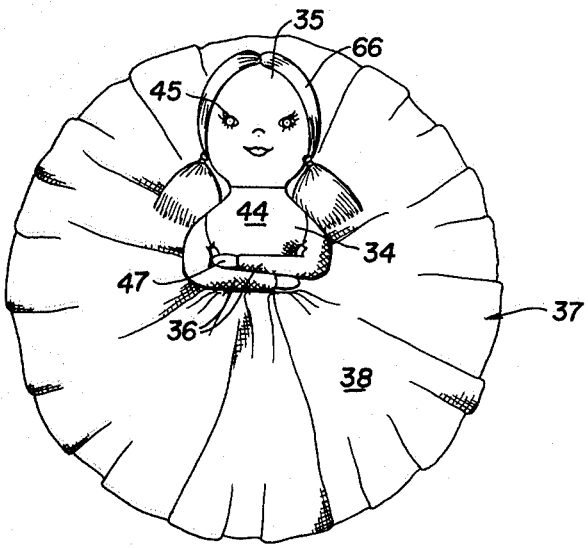
FIG. 3 is a plan view of the invention on a reduced scale illustrating how the reversible doll can be placed on a bed or the like for decorative purposes.
Figure 6:
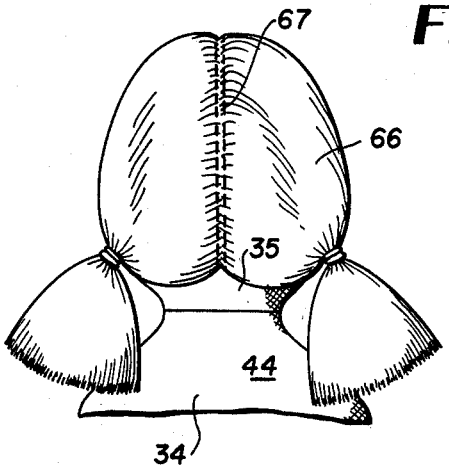
FIG. 6 is a fragmentary rear elevation of one head portion of the doll body showing simulated hair and its attachment.

The unstuffed cloth body, as described in FIG. 4, is now turned right side out and stuffed thoroughly through the open side between the points 51 and 52, taking care to stuff the body 30 with sufficient density to prevent the two heads 35 from flopping back and forth. As explained, it is desired that the body 30 be made comparatively rigid so that the doll will not tend to collapse. After the stuffing operation, the open seam of the body 30 between the points 51 and 52, FIG. 24, is closed by hand-stitching.

Figure 25:
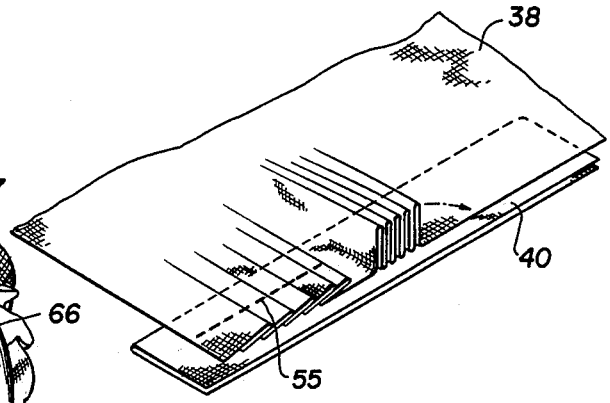
FIG. 25 is a fragmentary perspective view of a constructional step involved in making the reversible skirt and securing it to a waistband.

FIG. 7 shows a typical rectangular skirt blank, four of which are utilized to make the double layer reversible skirt 37, one pair of blanks 53 of like color or design for one ply 38 and another pair for the second ply 39. A pair of blanks 53 are joined by stitching entirely across one pair of ends with these blanks placed right sides together. The blanks are then stitched together at their other ends but are left unattached for a relatively short distance inwardly of corresponding longitudinal edges of the blanks. This results in the formation of one skirt section or ply 38 with a partly open seam at the top rear of the skirt and a completely closed seam at the front from top to bottom. A matching waistband 40, previously identified, FIG. 5, is conventionally formed for each skirt section or ply of the reversible skirt 37 from a provided blank 54 of cloth as shown in FIG. 12. Preferably, the bottom edges of each skirt ply 38 and 39 are hemmed before attaching the waistbands 40 and 41 to their tops. Referring to FIG. 25, showing one skirt ply 38 and matching waistband 40, each skirt ply has a double gathering stitch provided around its top between the free or unattached top edges where the back seam was left open. After properly folding and preparing the waistband, the top of each skirt ply is gathered as illustrated in FIG. 25 to match the length of the waistband and the waistband is then permanently attached to the gathered top edge of the skirt ply by stitching 55. The particular skirt ply or section is next turned right side out and slipped over the head of the doll figure 31 or 32 having the matching covering cloth 44–46 on the body 30. The skirt ply is adjusted downwardly on the body 30 to the waist region with the rear skirt seam still open at the top. Following conventional finishing adjustments, the rear skirt opening is sewed up and the associated waistband 40 or 41 is sewed to the doll body completely around the body. The identical processing steps are carried out for the second ply 38 or 39 and second matching waistband 40 or 41. With the wrong sides of the two skirt plies 38 and 39 together, their bottom edges are now sewed together at 56 completely around the reversible skirt.

Referring to FIG. 2, the doll figure 32 may be provided with a hat 57 and a matching or compatible apron 58. While the details of these components may vary, the hat 57 is constructed from a circular blank 59 of cloth as shown in FIG. 18 and a section of lace trim 60 or the like shown in FIG. 19. The apron 58 is made up from a square blank 61 and attached blank sections 62, 63 and 64, FIGS. 8 to 11, all joined in a conventional manner to form the body of the apron 58, shoulder straps 65 and other conventional parts. The apron can be attached permanently to the doll figure 32 or can be removably tied thereon whichever is preferred.

Suitable hair pieces 66 for the two doll figure heads 35 are preferably formed from yarn and are placed on the two heads 35 and stitched thereto at the centers of the heads and hair pieces as at 67. The cap 57 is mounted and may be tacked on the head of doll FIG. 32 after placement of the hair piece.

Variations may be made in the constructional details of the reversible doll under the invention, but in all cases the construction of the stuffed body 30 will be as described as this is a very important feature, including the cloth coverings for chest and back sections 34 and arms 36 on the two doll figures 31 and 32 which match respective layers of the skirt 37. Also included in all cases is the arrangement of the arms 36 on both doll figures, curved and crossing at the front of each figure near the waist. Since the arms including the hands are fully stuffed along with the remainder of the body 30, the two sets of arms are comparatively rigid and will tend to remain placed as shown and will not flop around. Aside from good appearance, the folded arms, see FIG. 4, form protrusions or bulges beneath the reversible skirt in the abdominal region, FIG. 1, and tend to encourage fullness in the free-hanging skirt helping it to fan out fully toward the bottom. Also, the described construction of the reversible skirt and its mounting on the body 30 with the two waistbands 40 and 41 is an important feature.

It is to be understood that the form of the invention herewith shown and described is to be taken as a preferred example of the same, and that various changes in the shape, size and arrangement of parts may be resorted to, without departing from the spirit of the invention or scope of the subjoined claims.

I claim:

1. A stuffed reversible doll comprising a stuffed body which is unitary and includes oppositely longitudinally extending body sections having the stuffing contained within fabric covering to form individual doll figures joined at a common waist, said fabric coverings for said individual doll figures being of different fabric patterns and forming the stuffing envelope of said unitary stuffed body, a reversible skirt attached to the stuffed body at said common waist and adapted to conceal one doll figure while exposing the other doll figure to view in each of two positions of use, said skirt formed in two fabric plies and each ply having a different fabric pattern, the fabric pattern of one skirt ply matching the permanently attached fabric covering on one doll figure and the fabric pattern of the other skirt ply matching the permanently attached fabric covering on the other doll figure, said reversible skirt in either of its two positions of use coacting with one of said permanently attached fabric coverings on said doll figures to present the appearance of a full length dress on such figure having one fabric pattern, each ply of the two ply reversible skirt having a waist extension thereon overlapping and surrounding a comparatively narrow surface area of one doll figure immediately adjacent to and on one side of the common waist, and a pair of independent decorative waistbands overlying and surrounding said waist extensions of the skirt plies and substantially concealing the waist extensions and being attached therewith to said stuffed body, said waist extensions and their associated waistbands conforming to the shape of the doll at the waist areas of the individual doll figures.

2. A stuffed reversible doll as defined in claim 1, and each doll figure of said stuffed body including a pair of arms having opposing folded substantially horizontal hand and forearm portions arranged immediately above and below said common waist in approximate parallelism.

* * * * *